US005604946A

United States Patent [19]

Stenerson

[11] Patent Number: 5,604,946

[45] Date of Patent: Feb. 25, 1997

[54] MULTI-PURPOSE FENCE BUILDING TOOL

[76] Inventor: Wilfred W. Stenerson, 10570 Hwy. 16, Eagle, Id. 83616

[21] Appl. No.: 202,392

[22] Filed: Feb. 25, 1994

[51] Int. Cl.[6] ..... B25F 1/00

[52] U.S. Cl. ..... 7/117; 254/243; 254/262

[58] Field of Search ..... 7/117; 254/243, 254/252, 257, 261, 262

[56] References Cited

U.S. PATENT DOCUMENTS 547,340 10/1895 Farrier ..... 7/117

782,169 2/1905 Opocensky ..... 254/243

*Primary Examiner*—Bruce M. Kisliuk

*Assistant Examiner*—Joni B. Danganan

*Attorney, Agent, or Firm*—Craig M. Korfanta

[57] ABSTRACT

A multi-purpose fencing tool which includes an elongated member (2) having a slidably adjustable flange (3) which may be positioned and fixed along the length of elongated member (2). Elongated member (2) includes one end having a point extending therefrom for engaging a link on a chain and the other end presents a flattened surface for tamping. Elongated member (2) also includes a plurality of holes along its length so that slidably adjustable flange (3) may be positioned along the length of elongated member (2) and fixed in its location. The tool may serve as a post puller, as an implement for tamping and compacting fill around a newly installed fence post, as an implement for assisting the fence builder in easily pulling fencing wire from a spool and as an implement for tensioning fencing wire prior to securing the wire to the post.

12 Claims, 8 Drawing Sheets

MULTI-PURPOSE FENCE BUILDING TOOL

BACKGROUND OF THE INVENTION

1. Technical Field

The present invention relates in general to hand tools and more particularly to a tool which is designed for a number of applications related to the activity of fence building. These various applications include the following: assisting the fence builder in pulling existing fence posts; tamping back fill which is placed around a fence post following insertion of the fence post in its hole; serving as a spooling mechanism for assisting the fence builder in pulling fencing wire from a spool and laying it out prior to attaching the fencing wire to the post and tensioning the fencing wire for attachment to the posts.

2. Background

Fencing for agrarian purposes, particularly fencing in the wide open and expansive areas of the western United States involves installation, upkeep and repair of literally hundreds of miles of fenced enclosures. The individuals who are responsible for the construction, upkeep and maintenance of these fences may be called upon to build miles of this type of fencing daily. During the peak season for maintenance and repair, an individual may maintain ten to twenty miles of fencing on any given day. As such, the tools of the trade are critical for the performance of the job. The more efficiently a tool performs a function, the more effectively the individual charged with these responsibilities becomes at performing these duties.

The prior art discloses a variety of tools which individually and separately perform the functions of the present invention. However, none of the prior art discloses a single tool which combines all of the functions set forth above in one single tool. The advantages to the combination of multiple functions in a single tool is readily apparent. An individual who sets out for a day of fence building, maintenance or repair, will perform their function far more efficiently if their opposed to the transportation of a variety of tools necessary to perform the work.

It is an object of this invention to provide a means for combining the benefits of several tools in one single device so that the fence builder may perform more efficiently and effectively.

Further objectives and advantages are set forth in the course of the following disclosure of the present invention.

DISCLOSURE OF INVENTION

The present invention meets the objectives stated above by providing an elongated member having a slidably adjustable flange which may be positioned and fixed along the length of the elongated member.

The elongated member may be modified so that one end provides a point for engaging a link on a chain or other tensile member, and the other end, a flattened surface for tamping.

The elongated member is further modified so that a plurality of holes are provided along its length so that the slidably adjustable flange may be positioned along the length of the elongated member and pinned or otherwise fixed in its location along the length of the elongated member. By adjusting the position of the flange, this implement may be used for a number of different functions, as illustrated herein.

When the flange is positioned nearest to one end, the implement may serve as a post puller. The elongated member is positioned on the ground adjacent to a post to be removed, with the flange face in contact with the surface of the ground, restricting further penetration of the elongated member into the ground. Positioned as such, the implement serves as an elevated fulcrum point in the following manner. A chain is wrapped around the post which is to be removed at a point along the length of the post as close to the ground as possible. The chain is then pulled tightly up and over the end of the elongated member where the tapered or pointed end of the elongated member is engaged through a chain link. The opposite end of the chain is then attached to a means for exerting a tensile force against the length of the chain. This force is typically applied by mechanical means, either tractor or some other motorized vehicle, or a draft animal such as a horse or mule.

As force is applied to the chain, the implement serves as a fulcrum point, transferring the force applied to the first leg of the chain, between the pulling means and the fulcrum, along the second leg of the chain, between the fulcrum and the end of the chain wrapped around the fence post, and ultimately to the post itself removing the post from the ground, thereby converting a horizontal pulling force to a vertical pulling force.

Following removal, it is often desirable to replace an old post with a new one. Once a new post is set in the hole, the implement may be adapted for tamping by removing the slidable flange and using the flattened end of the elongated member for tamping fill material in and around the post hole.

Once the posts are set, wire must be strung in order to complete the fencing. Typically, fencing wire is provided for use on spools. Using the invention, wire may be easily stripped off a spool by adjusting the flange to a point near the middle of the length of the elongated member. The spool is then placed on the elongated member in such a manner which allows the elongated member to act essentially as an axle or pivot point for the spool. The spool rests against the flange face and rotates freely when wire is pulled from the spool. In this manner, wire may be readily drawn off the spool.

Once the wire is stretched out along side the post, it must be secured to the post. In order to do this, wire must first be stretched so that it is taut when secured to the post. The present invention accomplishes this tensioning or tightening function by acting as a lever in the following manner: first, the elongated member is braced against a fence post perpendicular to the longitudinal axis of the fence post, then the wire is wrapped around the fence post and tied off on one end of the elongated member of the apparatus; next, with the fence post acting as a fulcrum point, the elongated member is used as a lever which is rotated about the fulcrum point thereby tensioning the wire as needed; and finally, the wire is tied off in this position.

The unique combination of functional elements combined in this one device allow fencing operations, whether construction or maintenance and repair, to proceed more efficiently and more economically.

BEST MODE FOR CARRYING OUT INVENTION

Figure 1A:
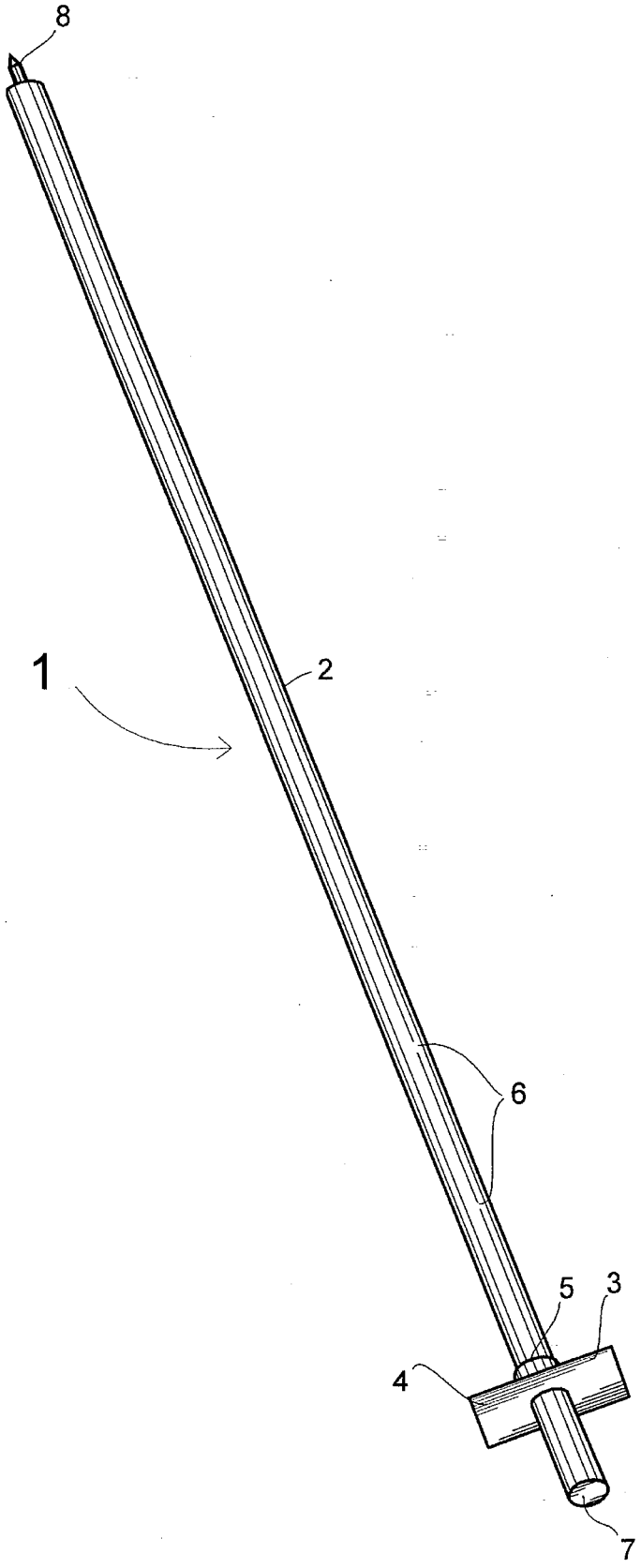
FIG. 1A is an isometric view of the multi-purpose fence building tool which embodies the principals of the invention.

The multi-purpose fencing tool 1 is shown in its preferred embodiment in FIGS. 1A through 5, inclusive. Referring to FIG. 1A, elongated member 2 accepts a flange 3, which is slidably adjustable along the length of the elongated member 2. Flange 3 consists of a flange plate 4, and a flange collar 5. A plurality of holes 6 are drilled through elongated member 2 perpendicular to the longitudinal axis of elongated member 2. Elongated member 2 can be manufactured from a metal bar or a metal pipe.

In the preferred embodiment elongated member 2 is adapted to provide a flattened end 7 at one end of elongated member 2 and a pointed end 8 at the opposite end of elongated member 2. Typically, flattened end 7 is employed for tamping purposes and pointed end 8 is of a diameter small enough to pass through the link of a chain, yet of a diameter large enough to frictionally engage the chain link and withstand the tensile force exerted on a chain when the multi-purpose fencing tool 1 is being employed as a fulcrum, as described below.

Figure 1B:
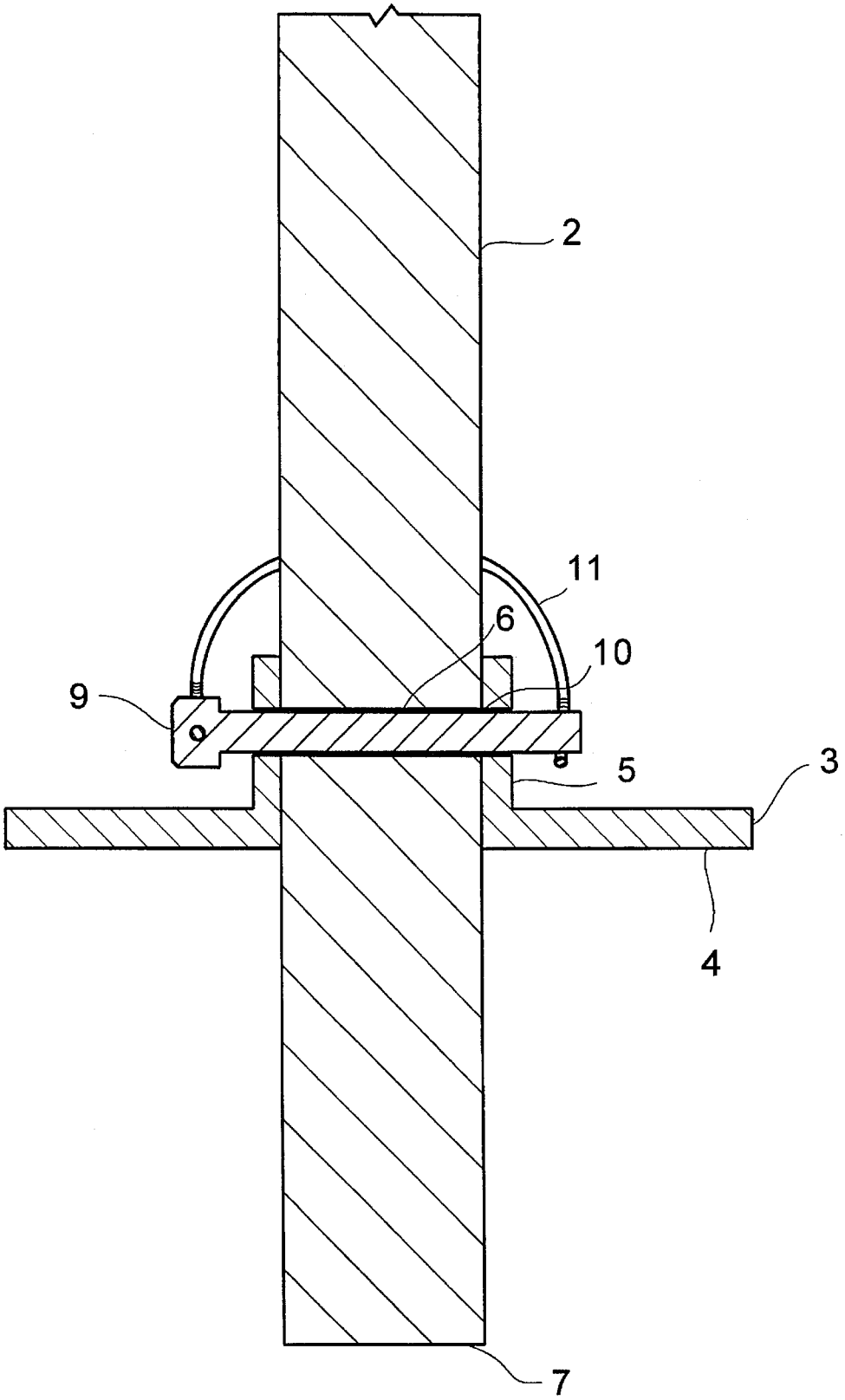
FIG. 1B is a detail cutaway of the multi-purpose fence building tool.

FIG. 1B shows a cut away of elongated member 2, flange 3 with flange plate 4, and flange collar 5. FIG. 1B also shows flange 3 positioned such that the hole drilled through flange collar 5 aligns with the hole 6 drilled through elongated member 2. The position of flange 3 is fixed along the length of elongated member 2 by aligning holes 6 and 10 and placing pin 9 through the corresponding holes 6 and 10. Here, pin 9 is kept in position by bale 11, however other keeper pins would work, such as a detent pin.

Figure 2A:
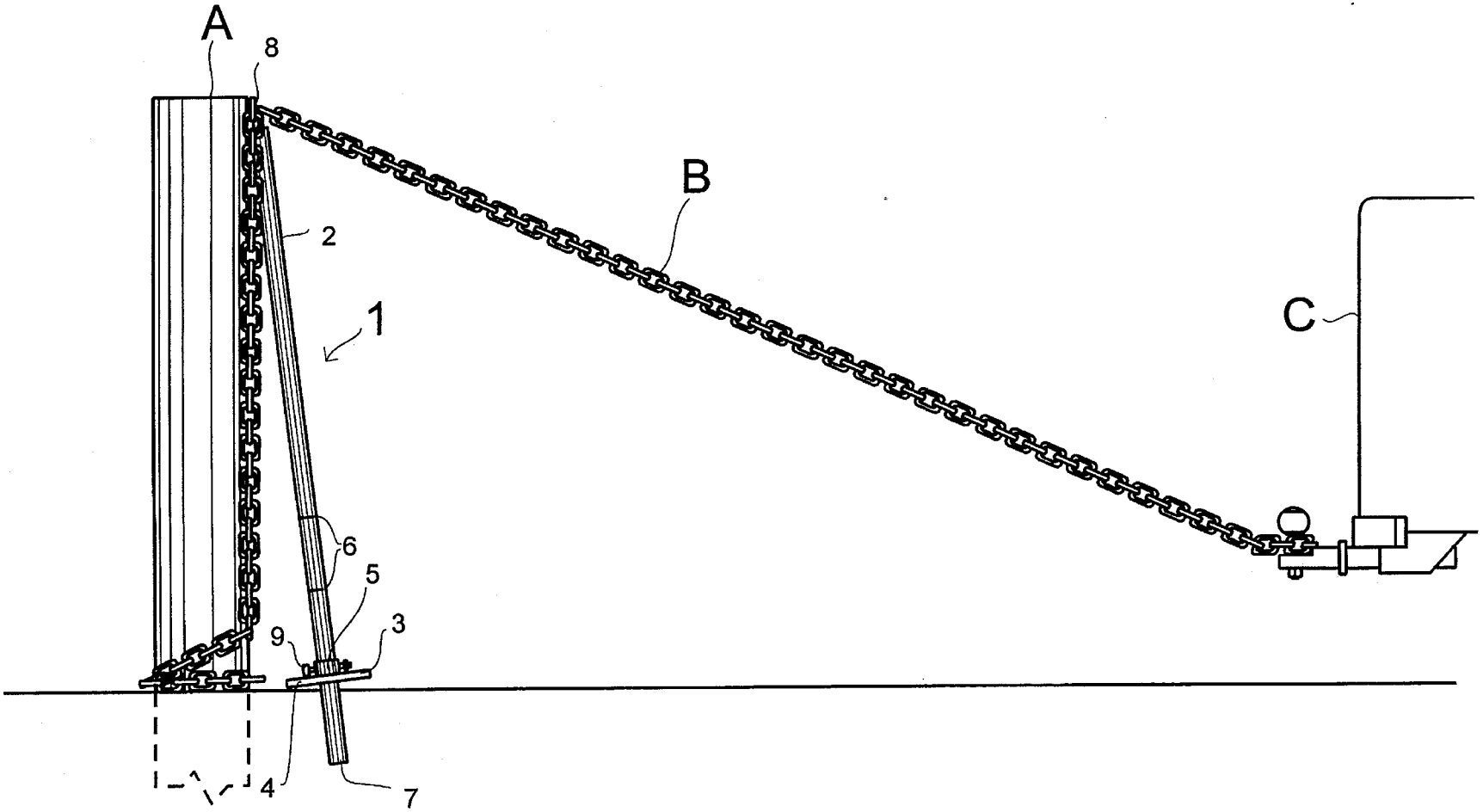
FIG. 2A is a side view showing the present invention performing the function of an elevated fulcrum for removal of a fence post.

FIG. 2A demonstrates the use of the multi-purpose fencing tool 1 as an elevated fulcrum point. The end of chain B is wrapped around fence post A which is to be removed. Here, chain B is secured around fence post A by hooking the end of chain B to the length of chain B. Chain B is then extended up along side post A and over pointed end 8 of elongated member 2, which is placed at a point as near post A as feasible with flat end 7 stuck in the ground and flange 3 resting against the surface of the ground. The remaining end of chain B is then secured to some means, C, for exerting a pulling or tensile force C.

Figure 2B:
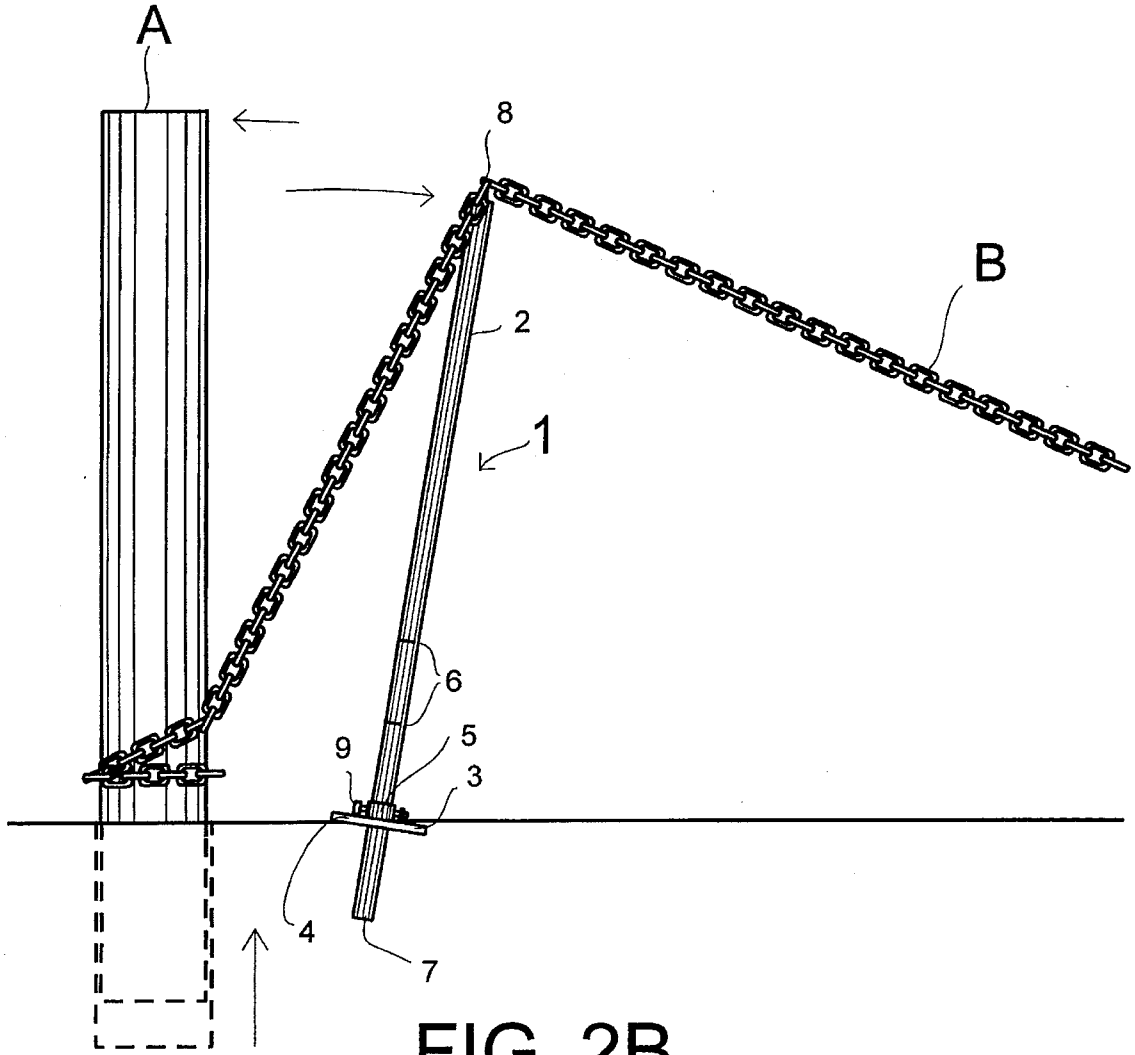
FIG. 2B is a side view showing the present invention being used as an elevated fulcrum for the purpose of removing a fence post.
Figure 2C:
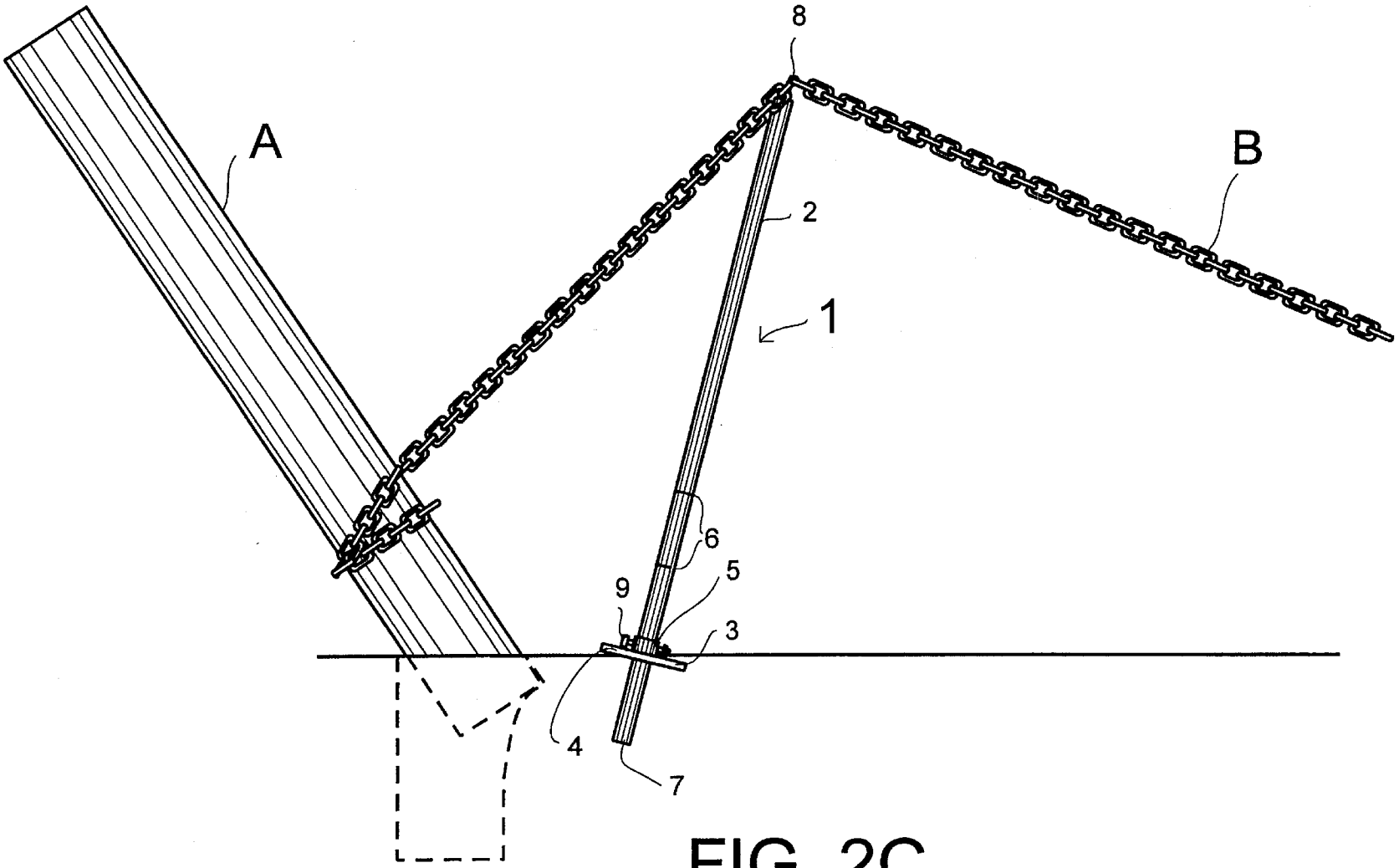
FIG. 2C is a side view showing the present invention being used as an elevated fulcrum for purposes of removing a fence post.

As shown in FIGS. 2B and 2C, as a force is exerted along the length of chain B by a pulling means C, the multi-purpose fencing tool 1 acts as a fulcrum transferring the tensile force applied between pulling means C and pointed end 8 to the length of chain B between pointed end 8 and the position along post A to which chain B is tied off. When sufficient force is applied along chain B, post A is removed as shown in FIGS. 2B and 2C.

Figure 3:
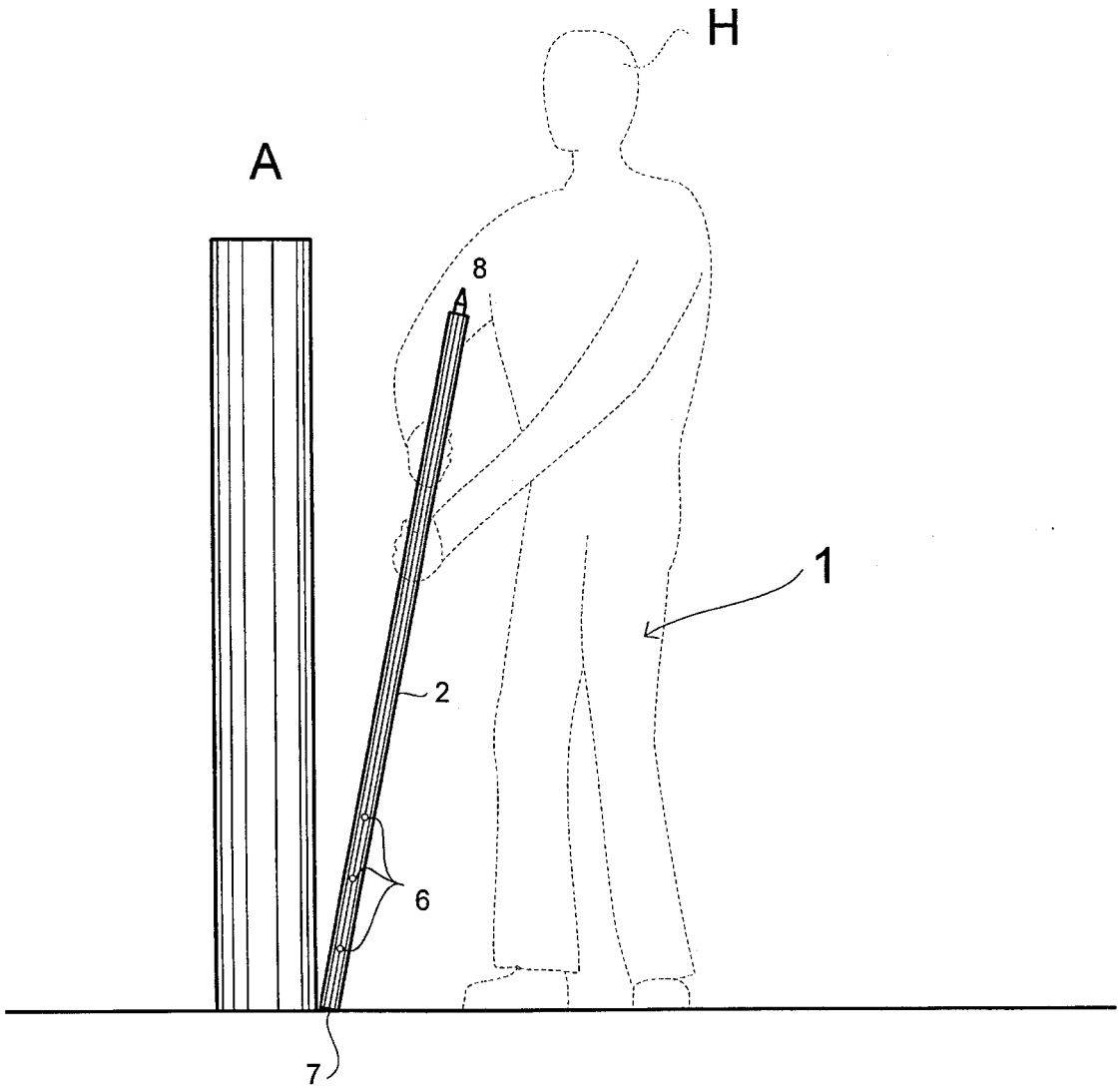
FIG. 3 is a side view showing the present invention being employed as a tamping rod.

FIG. 3 shows multi-purpose fencing tool 1 employed as a tamping implement. For this function, flange 3 is removed from elongated member 2 so as not to interfere with the tamping function.

Figure 4:
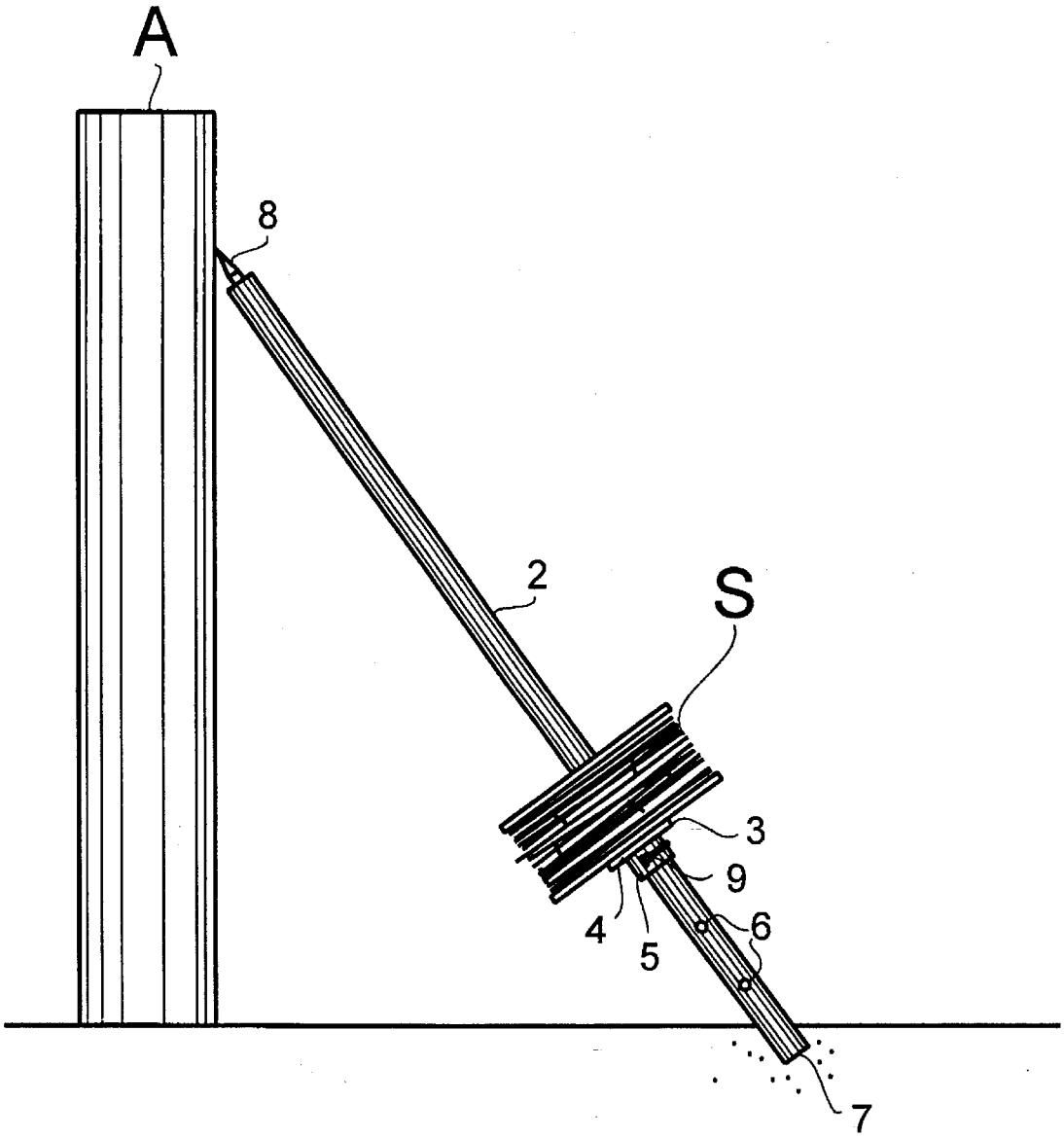
FIG. 4 is a schematic diagram showing the present invention being employed as an axle for the purpose of dispensing line or wire.

FIG. 4 shows the multi-purpose fencing tool 1 employed as a axle or pivot point for spool S. For this function, flange 3 is positioned near the mid point of elongated member 2, with fastening pin 9 and with collar 5 closest to the ground, presenting the flat face of plate 4 to spool S. Flattened end 7 is placed against the surface of the ground adjacent to post A. Pointed end 8 is placed against post A and pressed into the side of post A, securing elongated member 2 so that when wire is pulled off spool S, elongated member 2 remains stationary.

Figure 5:
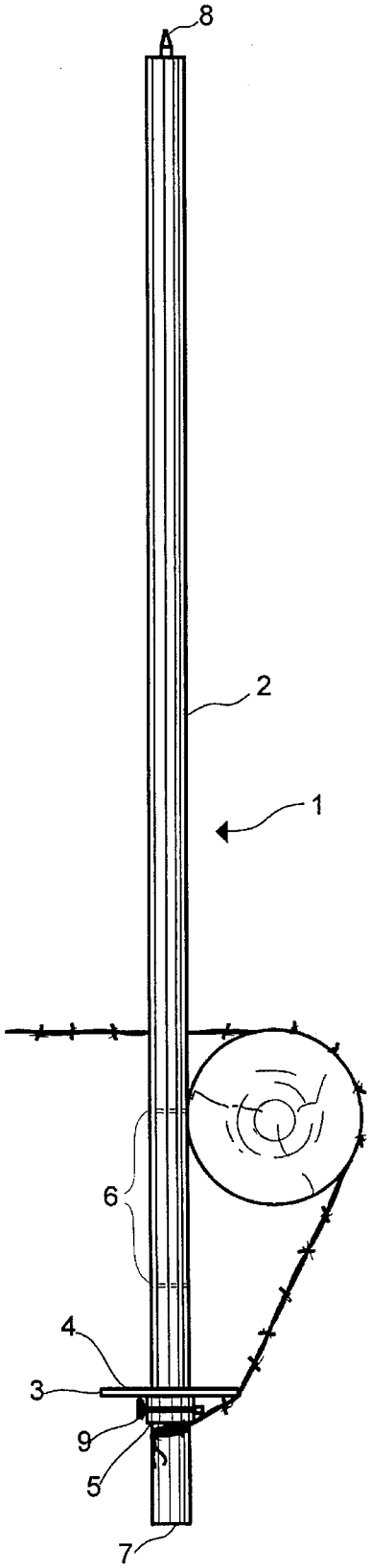
FIG. 5 is a schematic showing the present invention being employed as a wire stretching implement.

Finally, multi-purpose fencing tool 1 serves as a means for tensioning wire before attaching wire W to post A. FIG. 5 shows the multi-purpose fencing tool 1 employed for this purpose. Flange 3 is positioned at a point along elongated member 2 intermediate to flattened end 7 and the mid point of elongated member 2, securing flange 3 with pin 9. Multi-purpose fencing tool 1 is then positioned against post A perpendicular to the longitudinal axis of post A. Wire W is pulled around post A and inserted through hole 6 and secured to elongated member 2, or simply wrapped around and secured to elongated member 2 as is shown in FIG. 5. Positioned in such a manner, multi-purpose fencing tool 1 serves as a lever for tensioning wire W. Force is applied to the end of elongated member 2 located near pointed end 8. Fence post A serves as a fulcrum point and multi-purpose fencing tool 1 serves as a lever, exerting a tensioning force along wire W, pulling it until it is taut.

Modifications include replacing pointed end 8 with a groove or two tongued fork so that the pulling function could be accomplished with other tensile members such as a cable, rope or strap. Other applications include tree pulling, sign post pulling and installation, and even power and telephone pole removal.

While there is shown and described the present preferred embodiment of the invention, it is to be distinctly understood that this invention is not limited thereto but may be variously embodied to practice within the scope of the following claims.

I claim:

1. A tool for pulling posts and for stretching wire between fence posts, comprising:

an elongated member having two ends, a first end and a second end and a longitudinal axis, wherein the second end of the elongated member is modified to form a taper or point, the elongated member having a pair of holes therethrough disposed generally transversely with respect to the longitudinal axis with one hole being located proximate the first end and the other hole being located proximate a mid-point of the elongated member;

a flange slideably adjustable between two positions between the ends of the elongated member, a first post pulling position having the flange positioned proximate the first end of the elongated member and a second wire dispensing position having the flange positioned proximate the mid-point of the elongated member, the flange having a flange collar being configured to slidably receive the elongated member, the flange collar having a hole therethrough positioned to align with the hole in the elongated member, and the flange having a flange plate permanently affixed to the flange collar, the flange plate being configured to present a substantially planar surface perpendicular to the elongated member having a surface area substantially greater than the cross sectional area of the elongated member and great enough to prevent penetration of the elongated member into the ground past the flange in the first position and to support a spool of wire for dispensing in the second position; and a pin being removably engagable with the hole in the flange collar and the holes in the elongated member to fix the flange between the two ends of the elongated member in the first and second positions to selectively prevent the flange from sliding along the elongated member.

2. The tool according to claim 1, wherein the first end of the elongated member is modified to form a solid flat surface.

3. The tool according to claim 1, wherein the elongated member comprises a metal bar.

4. The tool according to claim 1, wherein the elongated member comprises a metal pipe.

5. The tool according to claim 1, wherein the first end of the elongated member is modified to form a solid flat surface.

6. The tool according to claim 1, wherein the elongated member comprises a metal bar.

7. The tool according to claim 1, wherein the elongated member comprises a metal pipe.

8. The tool according to claim 1, wherein the first end of the elongated member is modified to form a solid flat surface.

9. The tool according to claim 1, wherein the elongated member comprises a metal bar.

10. The tool according to claim 1, wherein the elongated member comprises a metal pipe.

11. A tool for pulling posts and for stretching wire between fence posts, comprising:

an elongated member having two ends, a first end, a second end and a longitudinal axis, the elongated member having a pair of holes therethrough disposed generally transversely with respect to the longitudinal axis with one hole being located proximate the first end and the other hole being located proximate a mid-point of the elongated member;

means for engaging a tensile member being attached to the first end;

a flange slideably adjustable between two positions between the ends of the elongated member, a first post pulling position having the flange positioned proximate the first end of the elongated member and a second wire dispensing position having the flange positioned proximate the mid-point of the elongated member, the flange having a flange collar being configured to slidably receive the elongated member, the flange collar having a hole therethrough positioned to align with the hole in the elongated member, and the flange having a flange plate permanently affixed to the flange collar, the flange plate being configured to present a substantially planar surface perpendicular to the elongated member having a surface area substantially greater than the cross sectional area of the elongated member and great enough to prevent penetration of the elongated member into the ground past the flange in the first position and to support a spool of wire for dispensing in the second position; and a pin being removably engagable with the hole in the flange collar and the holes in the elongated member to fix the flange between the two ends of the elongated member in the first and second positions to selectively prevent the flange from sliding along the elongated member.

12. The tool of claim 11 wherein the second end presents a solid flat surface.

* * * * *